US006913566B2

(12) United States Patent
Polikov et al.

(10) Patent No.: US 6,913,566 B2
(45) Date of Patent: Jul. 5, 2005

(54) SIZE ADJUSTMENT OF CORRUGATED BOARDS IN A BOX MAKING MACHINE

(75) Inventors: Yury Polikov, Pikesville, MD (US); Louis M. Sardella, Hunt Valley, MD (US)

(73) Assignee: Sun Automation Inc., Sparks, MD (US)

( * ) Notice: Subject to any disclaimer, the term of this patent is extended or adjusted under 35 U.S.C. 154(b) by 0 days.

(21) Appl. No.: 10/346,720

(22) Filed: Jan. 17, 2003

(65) Prior Publication Data

US 2004/0110448 A1 Jun. 10, 2004

Related U.S. Application Data

(63) Continuation of application No. 09/471,011, filed on Dec. 23, 1999, now Pat. No. 6,609,997.

(51) Int. Cl.[7] ..... B31B 1/25
(52) U.S. Cl. ..... 493/60; 493/365
(58) Field of Search ..... 493/60, 63, 64, 493/365, 367, 194, 199; 451/49, 82, 83; 83/509, 469

(56) References Cited

U.S. PATENT DOCUMENTS 4,736,660 A * 4/1988 Benach et al. ..... 83/174
4,846,774 A * 7/1989 Bell ..... 493/87
5,131,966 A * 7/1992 Coffey ..... 156/64
5,582,569 A * 12/1996 Kowalewski et al. ..... 493/52
5,879,278 A * 3/1999 Cox ..... 493/67
6,074,333 A * 6/2000 Rajala et al. ..... 493/346
6,106,448 A * 8/2000 Obara et al. ..... 493/11
6,267,034 B1 * 7/2001 Beckwith ..... 83/305

* cited by examiner

*Primary Examiner*—Eugene Kim
(74) *Attorney, Agent, or Firm*—William E. Mouzavires

(57) ABSTRACT

A rotary die cutter mechanism for cutting and/or creasing corrugated boards including a rotatable die cylinder with a cutting die, and a rotatable anvil against which the corrugated boards are cut as they pass between the die cylinder and the anvil. A computer is used to determine how much the speed of the anvil should be changed to compensate for changes in the diameter of the anvil so that the boards are cut to the desired dimension. A fine adjustment of the size of the boards to be cut is made by providing information to the computer representative of the specific die being used. The computer then calculates an adjusted speed of the anvil to cut the boards to the desired dimension, and then sends a signal to a motor for changing the speed of the anvil to the adjusted speed calculated by the computer.

15 Claims, 5 Drawing Sheets

DISPLAY SCREEN

```
GRINDER ENABLED
ANVIL THICKNESS
      .275 inch
CUT LENGTH O-RIDE  0
```

```
GRINDER ENABLED
ANVIL THICKNESS
      .275 inch
CUT LENGTH O-RIDE 50
```

```
GRINDER ENABLED
ANVIL THICKNESS
      .275 inch
CUT LENGTH O-RIDE-30
```

*FIG. 5*

SIZE ADJUSTMENT OF CORRUGATED BOARDS IN A BOX MAKING MACHINE

RELATED APPLICATION

This application is a continuation in part of U.S. application Ser. No. 09/471,011 filed Dec. 23, 1999, now U.S. Pat. No. 6,609,997, entitled METHOD AND APPARATUS FOR RESURFACING ANVIL BLANKET OF A ROTARY DIE CUTTER BOX-MAKING MACHINE. The entire disclosure of the aforementioned application is hereby incorporated herein by reference and made part hereof.

FIELD OF INVENTION

The present invention generally relates to corrugated box making machines and more particularly to a novel and improved method and apparatus to provide for small size adjustment of the corrugated boards produced during the rotary die cut process on a corrugated box-making machine.

BACKGROUND OF INVENTION

Rotary die cutters include a die drum or cylinder having on its surface a cutting die typically made of steel rule for cutting or creasing corrugated board against an anvil drum or cylinder. This process occurs as the board passes between the two drums. The anvil cylinder is circumferentially covered with 10 inch to 20 inch wide and initially 0.420 inch to 0.300 inch thick urethane blankets. As knives on the die drum cut the corrugated boards, the anvil urethane blankets wear down and change thickness.

It is well known that the surface speed of the anvil affects the accuracy of the die cut of the corrugated board. Ideally the surface speed of the anvil drum should be equal to the linear speed of the board as it travels through the die cutter. As the urethane blankets wear, the overall diameter of the anvil drum decreases which reduces the surface speed of the anvil and ultimately changes the cut size of the produced corrugated box.

Several systems exist to compensate for the change in diameter of the anvil by changing the rotational speed of the anvil drum in accordance with the change of the drum diameter. On some systems the die cutter operator manually measures the diameter of the anvil drum and then inputs the measurement into the control system, which then changes the rotational speed of the anvil drum. To provide for the fine anvil speed adjustment, an operator usually tries to "fool the system" and inputs a number in the control system that is higher or lower then the number corresponding to the real anvil diameter. This method is not accurate and requires several "trial and error" attempts. Also, a significant change of this number results in a large difference between the surface speeds of the die drum and the anvil drum, which leads to additional stresses on the die cutter components and the breaking of the die-cutter knives. Also, there are no provisions for the control system to "remember" this number, so when the same die is used the next time, the operator must repeat the "trial and error" procedure.

An improved system (the MicroGrind™ system) is disclosed in the above-identified patent application Ser. No. 09/471,011 where the position of the anvil grinding or trimming mechanism determines the diameter of the anvil drum automatically. The computer feeds this information into the control system, which then changes the rotational speed of the anvil drum. However, even if the surface speed of the anvil drum is perfectly correlated with the drum diameter, there is still a need to fine adjust the surface speed of the anvil drum within a small range, usually +/−3%, to achieve a perfectly sized corrugated box. There are several reasons for this need. One of them may be an imperfection of the cutting and creasing die that is mounted on the surface of the die drum. Another may be the change in the amount of impression of the die cutter knives and blades into the anvil.

OBJECT OF INVENTION

The object of the present invention is to provide novel and improved methods and apparatus for fine size adjustment of the corrugated boards produced during rotary die cut process in a corrugated box-making machine.

DRAWINGS

FIG. 5 is a view of the typical messages displayed on the screen of computer-operator interface, shown on FIG. 4.

DETAILED DESCRIPTION

Figure 1:
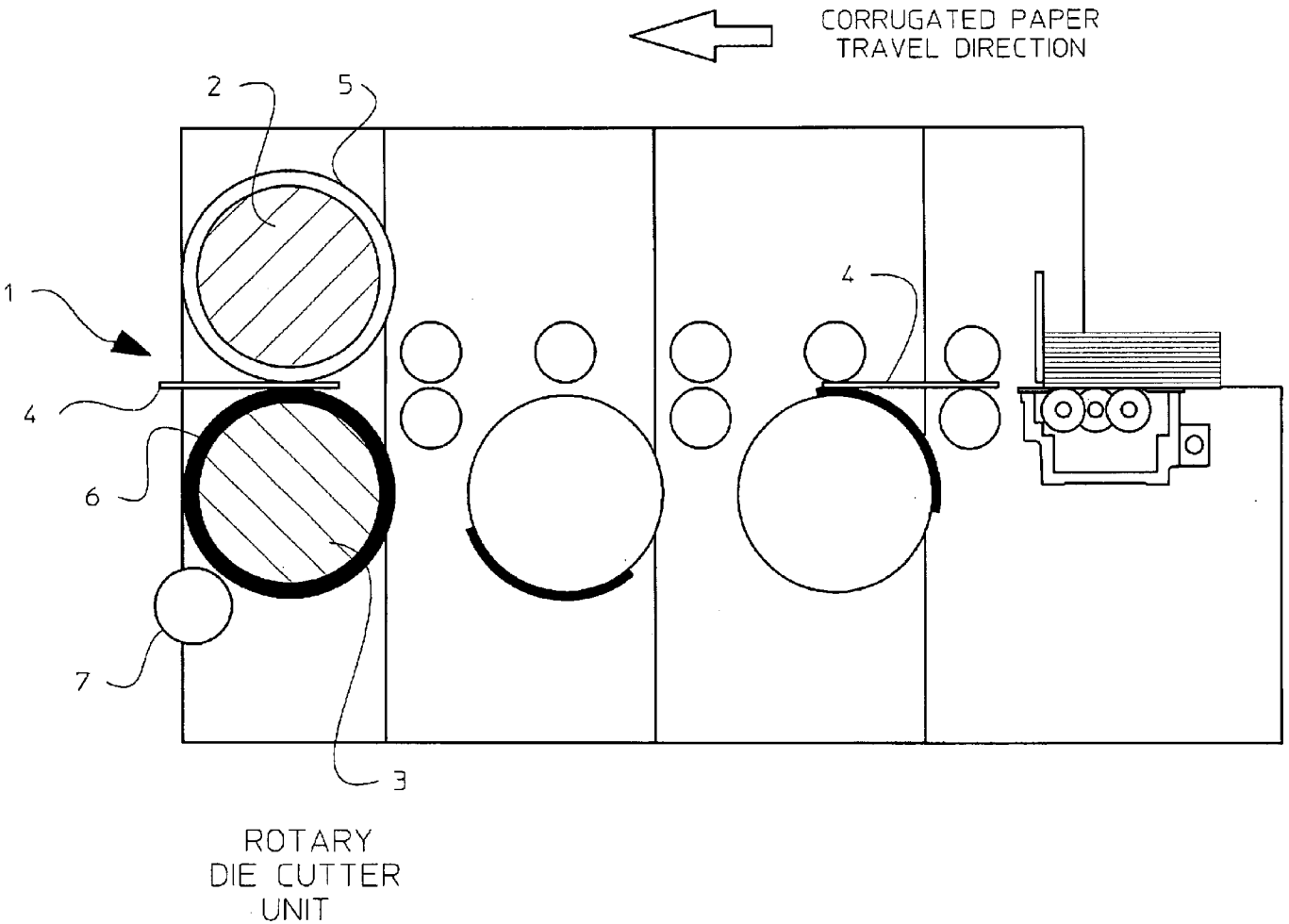
FIG. 1 is a schematic view of a box making machine.

Rotary die cutter of the corrugated box making machine 1 includes a cutting die cylinder 2 with fixed running diameter and an anvil cylinder 3, which receive in their nip corrugated boards 4 to be cut or creased by a cutting die, which uses steel rules 5 to cut corrugated boards against the anvil 3. The anvil cylinder includes steel drum and anvil blankets 6 typically made of urethane, which are wrapped and fixed around the surface of the drum.

As the sheets of corrugated paper run through the die cutter, the blades of the cutting and creasing die 5 penetrate through the anvil blankets 6 to obtain the desired cutting and scoring effect. This causes the anvil blankets 6 to wear down and changes the overall diameter of the anvil. To achieve high dimensional stability of the produced corrugated boxes, it is important that both the die cylinder 2 and the anvil cylinder 3 are driven with the same surface speed.

As the anvil blankets 6 wear, it is desirable to increase the rotational speed of the anvil cylinder 3. The goal is match the linear speed of the outer surface of the anvil cylinder to the running linear speed of the die cylinder 2, which equals the linear speed of the corrugated sheet passing through the die cutter.

Figure 2:
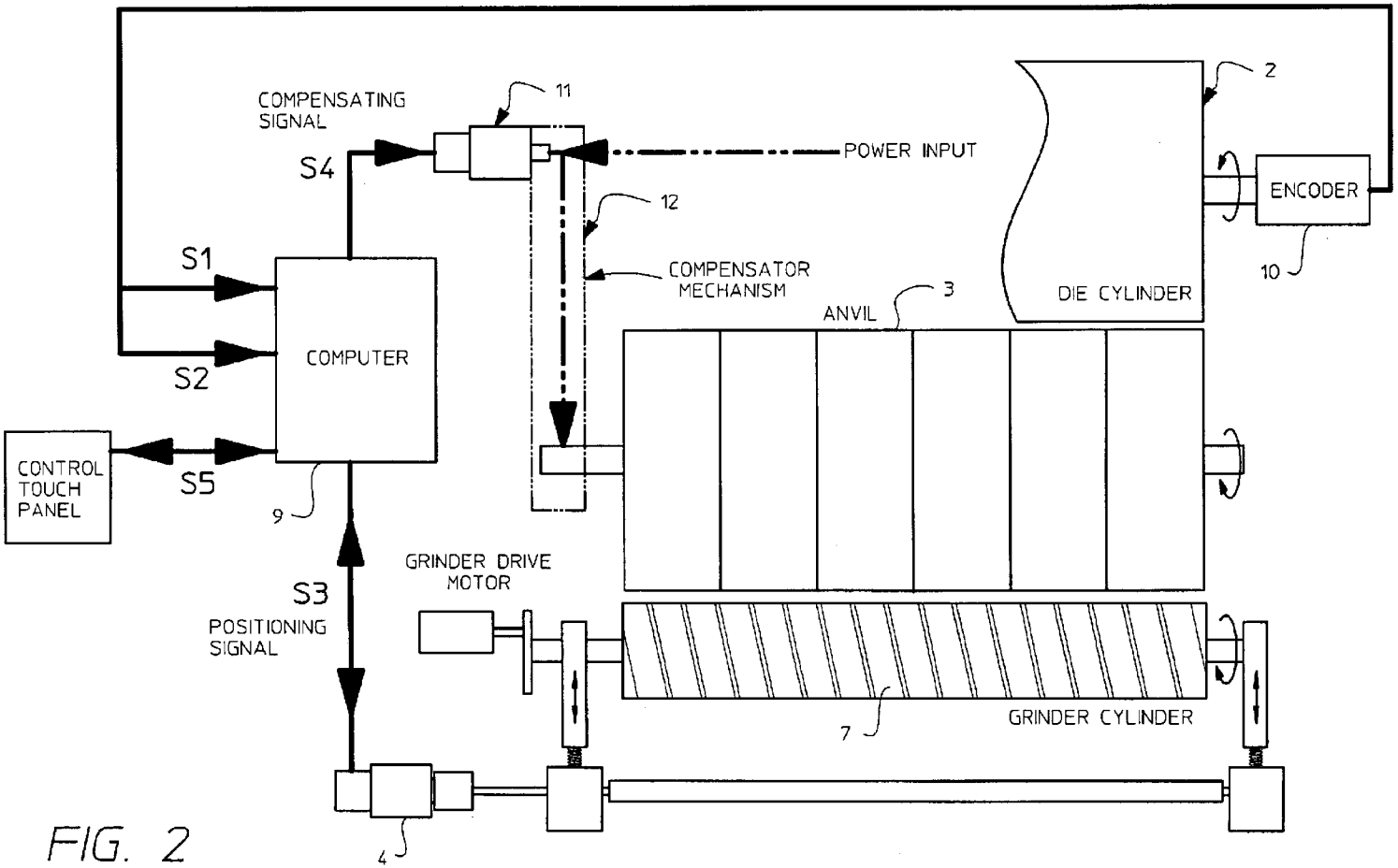
FIG. 2 is a schematic view including the anvil cylinder, die cylinder, grinder cylinder, computer, control touch panel and anvil speed compensator.
Figure 3:
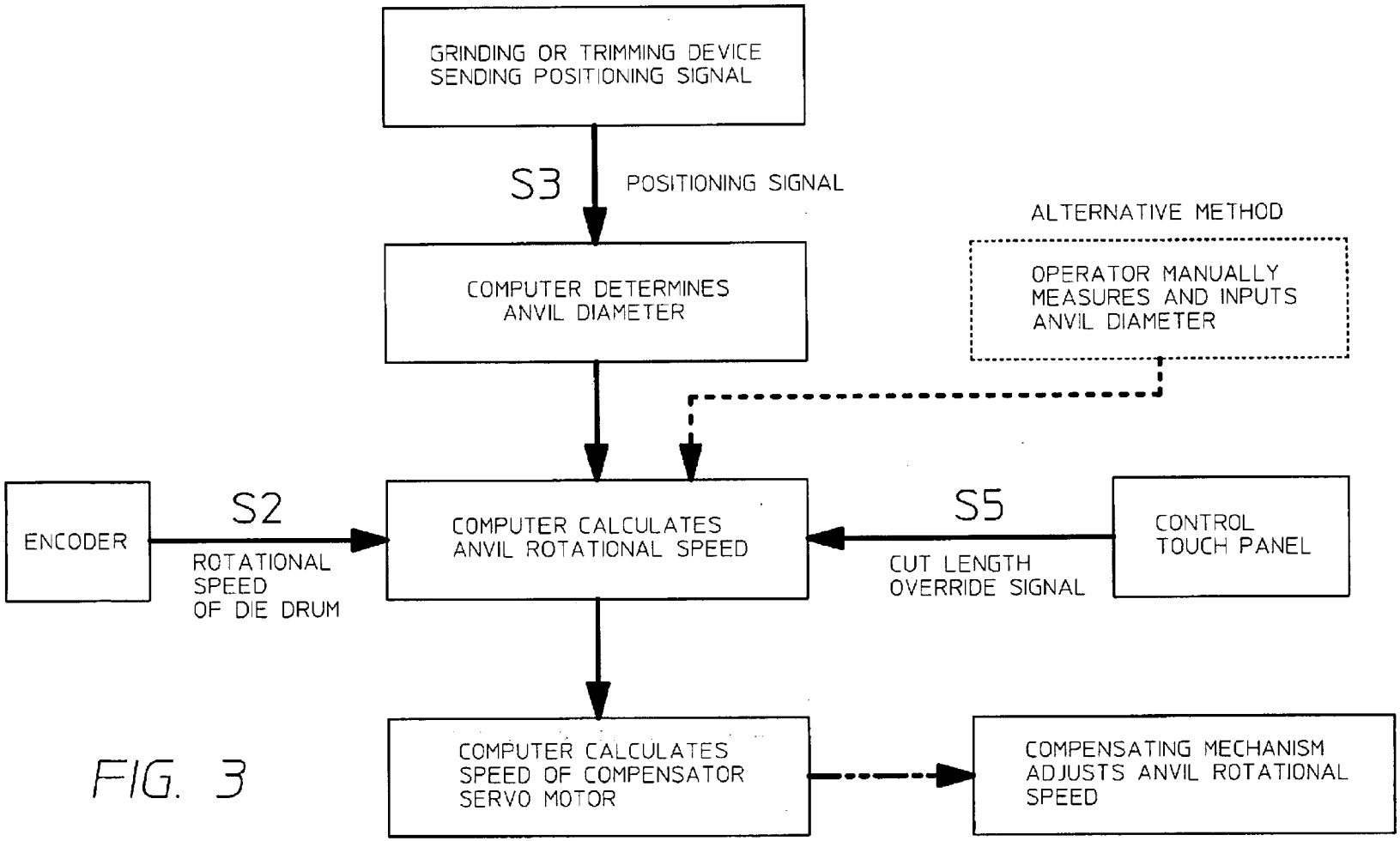
FIG. 3 is a process flow diagram used by the computer to determine the compensating signal sent to compensator servomotor.

The anvil blanket 6 is resurfaced by a MicroGrind™ system schematically shown in FIG. 2. The computer process flow diagram for the preferred embodiment is shown on FIG. 3.

The encoder 10 is attached to the rotating end of the die drum 2. The encoder 10 sends two different signals to the computer 9. Signal S1 brings information to the computer 9 on the number of die drum 2 revolutions, and is then used by the computer 9 to periodically initiate the grinding cycle. Signal S2 brings information on the rotational speed of the die drum. This value is measured in revolutions per minute and will be expressed in formulas as "RPM_D".

The grinding roll 7, which extends along the anvil cylinder 3, automatically grinds 0.001" from the surface of the anvil for every 10,000 corrugated sheets passing through the die cutter. This keeps the surface of the anvil even, level and smooth. The position of the grinding roll 7 is controlled by the servomotor 4, which takes its positioning signal S3 from the computer 9.

Since the computer 9 controls the movements of the grinding roll 7, at the end of each grinding cycle the computer 9 automatically determines the value of the anvil blanket thickness 6. This value is displayed on the screen of the computer-operator interface (FIG. 4 and FIG. 5) and automatically updated as the grinding cycle is performed. The computer 9 automatically calculates the diameter of the anvil 3, expressed in formulas as "DIA_A".

The computer 9 automatically calculates rotational speed of the anvil cylinder 3, expressed in formulas as "RPM_A", by using the formula:

$$\text{RPM_A} = \frac{(\text{RPM_D} \times \text{DIA_D})}{\text{DIA_A}} \qquad \text{(Formula 1)}$$

Where:

"RPM_A" is the calculated rotational speed of the anvil cylinder 3 (revolutions per minute);

"RPM_D" is the rotational speed of the die cylinder 2 (revolutions per minute);

"DIA_D" is the running diameter of the die cylinder 2. This is a fixed constant, in one preferred embodiment it is DIA_D=21.000 (inches);

"DIA_A" is the diameter of the anvil cylinder 3, (inches).

According to the present invention, the machine operator has the ability to change the value of the computer calculated rotational speed of anvil cylinder 3 ("RPM_A") within a small amount, +/−5% but preferably within +/−3%. This process is called "Cut Length Override".

Figure 4:
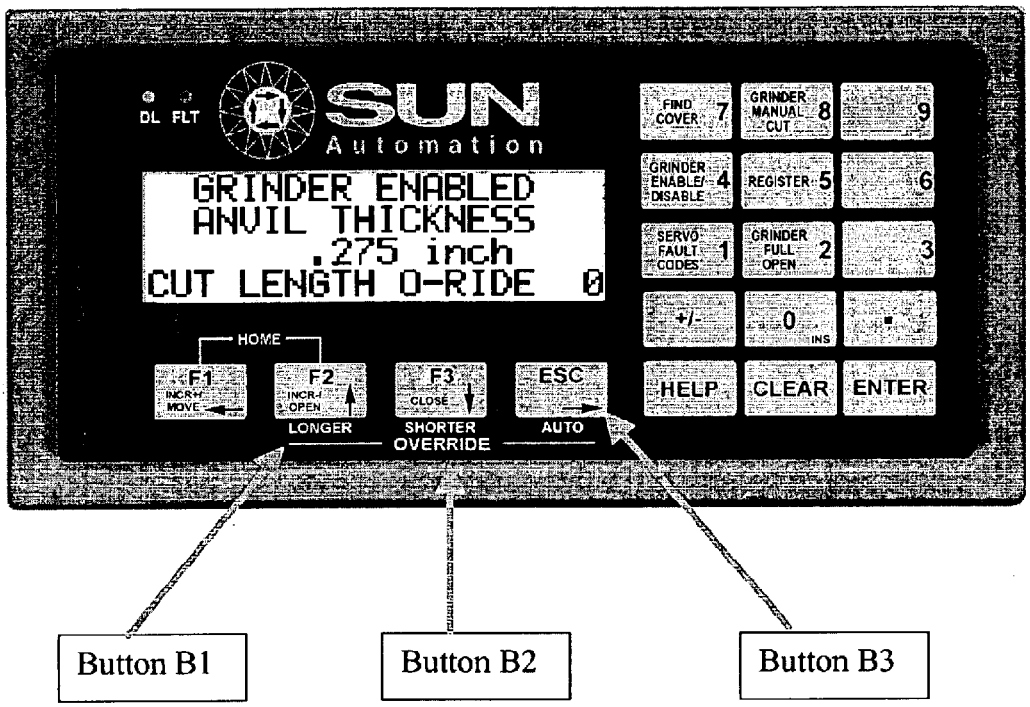
FIG. 4 is a view of the computer-operator interface (control touch panel).

To perform the "Cut Length Override", the operator pushes either buttons B1, B2 or B3 on the control touch panel of the computer-operator interface, shown on FIG. 4. This operation will input signal S5 (FIG. 3) in the computer 9 with the value of "Cut Length Override" factor expressed in formulas as "K". "K" is an integer and can take values from positive 50 to negative 50.

Pushing button B1, labeled "Override-Longer", increases value of "K". This operation will make the cut length of the box longer.

Pushing button B2, labeled "Override-Shorter", decreases the value of "K" and will make the cut length of the box shorter.

Pushing button B3, labeled "Override-Auto", brings value of "K" to zero. The system will run with no cut length override.

The value of "K" is displayed on the screen of computer-operator interface (FIG. 5) as "Cut Length O-Ride". Each time operator changes the value of "Cut Length Override" factor "K", the value on the screen also changes.

The value of "Cut Length Override" factor "K" is unique for each specific set of cutting and creasing dies and will be the same each time the specific set of dies is used. The value of "K" may be saved in the computer memory. If the machine has an automatic computer set-up feature, this value can be recalled from the computer memory and reused each time this particular set of dies is used.

When including "Cut Length Override" factor "K", Formula 1 becomes:

$$\text{RPM_AA} = \frac{(1 + K \times S) \times (\text{RPM_D} \times \text{DIA_D})}{\text{DIA_A}} \qquad \text{(Formula 2)}$$

Where:

"RPM_AA" is the calculated adjusted rotational speed of the anvil cylinder 3 (revolutions per minute).

"K" is the "Cut length Override Factor". "K" is an integer and takes values from negative 50 to positive 50 and is the number the operator inputs from the display screen of the computer-operator interface (FIG. 4);

"S" is a constant with a value that depends on the amount of adjustment needed for the anvil cylinder 3 rotational speed "RPM_A", calculated in Formula 1. In the described embodiment the adjustment for "RPM_A" is within the range of +/−3% and "S" takes value of 0.0006. In other embodiments where for example the adjustment range is +/−5%, S would have the value of 0.001.

The machine operator will input at the control panel (FIG. 4) the cut length override factor, K, until the corrugated boards are cut at the desired length. Subsequently no further length adjustments are required for the same box length while using the same die.

Based on the value of "RPM_AA", the computer sends compensating signal S4 to a servomotor 11 that controls compensating mechanism 12, which adjusts the rotational speed of the anvil cylinder 3 to the value of "RPM_AA". The result is that the corrugated boards are cut to the desired length.

Although preferred embodiments of the invention have been shown and described above, other forms of the invention will become apparent to those of ordinary skill in the art but without departing from the scope of the invention indicated in the appended claims.

We claim:

1. In a rotary die cutter for cutting and/or creasing corrugated boards in a box-making machine, wherein the rotary die cutter includes a rotatable die cylinder having at least one cutting die, and a rotatable anvil against which the corrugated boards are cut as they pass between the die cylinder and anvil, the method of adjusting a length dimension to be cut on the board by the die including the steps of using a computer for determining how much the speed of the anvil should be changed to cut the board at a desired length dimension, and wherein the method further includes providing an information input to the computer representative of the specific die used on the die cylinder and for the purpose of calculating with the computer an adjusted speed of the anvil to cut the board at the desired length dimension, and sending a signal with the computer to a motor for changing the speed of the anvil to the adjusted speed calculated by the computer and wherein the computer calculates the adjusted speed according to the following formula:

$$\text{RPM_AA} = \frac{(1 + K \times S) \times (\text{RPM_D} \times \text{DIA_D})}{\text{DIA_A}}$$

Where:

RPM_AA is the adjusted speed (in rpm's) speed of the anvil to be calculated

K is an integer and takes values from negative 50 to positive 50 and is the number input into the computer by the operator S is the constant 0.0006

RPM_D is the rotational speed of the die cylinder in revolutions per minute

DIA_D is the running diameter of the die cylinder in inches

DA_A is the diameter of the anvil cylinder in inches.

2. The method defined in claim 1 wherein the information input to the computer is effected manually using a control touch panel.

3. The method defined in claim 1 further including: the step of periodically resurfacing the anvil to maintain it smooth and even and using the computer to automatically calculate the resulting change in the diameter of the anvil and to automatically adjust the speed of the anvil accordingly.

4. The method defined in claim 3 further including the steps of using an abrading cylinder automatically and periodically movable radially into and away from the anvil to resurface the anvil every predetermined number of revolutions of the anvil, and using the change of position of the abrading cylinder relative to the anvil cylinder to calculate the diameter change of the anvil and the consequent change of anvil speed.

5. The method defined in claim 1 further including the steps of resurfacing the anvil, using the computer to change the speed of the anvil in accordance with the change in diameter of the anvil after resurfacing, and using the computer to again change the speed of the anvil if necessary in order to cut the corrugated boards to a predetermined length.

6. The method defined in claim 5 including the steps of using an abrading cylinder to resurface the anvil and using the change in the position of the abrading cylinder relative to the anvil to determine the change in diameter of the anvil.

7. In a box-making machine including a rotary die cutter, the method of resurfacing the blanket of the anvil of the rotary die cutter including the steps of abrading the surface of the blanket with a rotating abrading cylinder engaging the surface of the blanket during box production while the rotary die cutter is cutting or creasing corrugated boards, using the position of the abrading cylinder relative to the anvil to determine how much the speed of the anvil should be changed to compensate for the change in the diameter of the anvil, and wherein during box production while the die cutter is operating on the boards the abrading cylinder through the use of a computer is automatically and repeatedly fed radially into the anvil blanket a predetermined amount and then retracted from the anvil blanket to repeatedly resurface the anvil blanket, change in the diameter of the anvil blanket is automatically computed and the speed of the anvil is automatically changed to compensate for the change in the diameter of the anvil blanket, and wherein the size of the corrugated boards to be cut by the die cylinder is adjusted by inputting in the computer information relating to said die cutter mechanism, and the computer calculates an adjusted anvil speed to cut the corrugated boards to the desired size.

8. In a rotary die cutter for cutting and/or creasing corrugated boards in a box-making machine, wherein the rotary die cutter includes a rotatable die cylinder having at least one cutting die, and a rotatable anvil against which the corrugated boards are cut as they pass between the die cylinder and anvil, a computer for controlling the operation of a motor which rotates the anvil, said computer having means for calculating an adjusted speed of the anvil to cut the corrugated boards to a desired length dimension, and means for inputting into the computer information relating to dies on the die cylinder, said information being used by the computer in the calculation of the adjusted anvil speed to cut the corrugated boards to the desired length dimension and wherein the computer calculates the adjusted speed according to the following formula:

$$\text{RPM_AA} = \frac{(1 + K \times S) \times (\text{RPM_D} \times \text{DIA_D})}{\text{DIA_A}}$$

Where:

RPM_AA is the adjusted speed (in rpm's) speed of the anvil to be calculated

K is an integer and takes values from negative 50 to positive 50 and is the number input into the computer by the operator S is the constant 0.0006

RPM_D is the rotational speed of the die cylinder in revolutions per minute

DIA_D is the running diameter of the die cylinder in inches

DA_A is the diameter of the anvil cylinder in inches.

9. The rotary die cutter defined in claim 8 including a control panel for inputting said information for calculating an adjusted speed of the anvil.

10. The rotary die cutter defined in claim 8 further including means for resurfacing the anvil, and wherein said computer has means for changing the speed of the anvil in accordance with a change in the diameter of the anvil due to resurfacing of the anvil.

11. The rotary die cutter defined in claim 10 further including a control panel for inputting information into said computer for controlling the speed of the anvil, and a display screen for indicating values relating to anvil thickness and cut length of the corrugated boards.

12. In a rotary die cutter for a box-making machine including a die cutter and an anvil cylinder including a blanket on the surface thereof, the improvement comprising an abrading cylinder mounted for rotation along the anvil cylinder for abrading the surface of the blanket, means including a computer for automatically and repeatedly moving the abrading cylinder radially towards and away from the blanket to bring the abrading cylinder into and out of engagement with the anvil blanket to resurface the blanket during box production while the die cutter is operating on corrugated boards, and means including said computer for automatically determining the position of the abrading cylinder relative to the anvil for calculating the diameter of the anvil and automatically changing the speed of the anvil in accordance with the diameter of the anvil during box production while the die cutter is operating on corrugated boards, said computer having means for calculating an adjusted speed of the anvil to cut the corrugated boards to a desired dimension, and means for inputting into the computer information relating to dies on the die cylinder, said information being used by the computer in the calculation of the adjusted anvil speed.

13. The rotary die cutter defined in claim 12 including a control panel for inputting said information.

14. The rotary die cutter defined in claim 13 wherein the computer calculates the adjusted speed according to the following formula:

$$\text{RPM_AA} = \frac{(1 + K \times S) \times (\text{RPM_D} \times \text{DIA_D})}{\text{DIA_A}}$$

Where:

RPM_AA is the adjusted speed (in rpm's) speed of the anvil to be calculated

K is an integer and takes values from negative 50 to positive

S is the constant 0.0006

RPM_D is the rotational speed of the die cylinder in revolutions per minute

DIA_D is the running diameter of the die cylinder in inches

DA_A is the diameter of the anvil cylinder in inches.

15. In a rotary die cutter for cutting and/or creasing corrugated boards in a box-making machine, wherein the rotary die cutter includes a rotatable die cylinder having at least one cutting die, and a rotatable anvil against which the corrugated boards are cut as they pass between the die cylinder and anvil, means for resurfacing the anvil, a computer for controlling the operation of a motor which rotates the anvil and for changing the speed of the anvil in accordance with a change in the diameter of the anvil due to resurfacing the anvil, said computer having means for overriding the speed of the anvil and for calculating an adjusted anvil speed to cut the corrugated boards to a desired length dimension based on a characteristic of said die, and means for inputting into the computer information relating and specific to said die, said information being used by the computer in the calculation of said adjusted anvil speed to cut the corrugated boards to the desired length dimension.

* * * * *